United States Patent [19]

Axer

[11] Patent Number: 4,493,585

[45] Date of Patent: Jan. 15, 1985

[54] BITUMINOUS FINISHER

[75] Inventor: Heinrich Axer, Nettetal, Fed. Rep. of Germany

[73] Assignee: Joseph Vogele AG, Munich, Fed. Rep. of Germany

[21] Appl. No.: 366,004

[22] Filed: Apr. 6, 1982

[30] Foreign Application Priority Data

| | | | |
|---|---|---|---|
| Apr. 7, 1981 | [DE] | Fed. Rep. of Germany | 3114049 |
| Mar. 18, 1982 | [DE] | Fed. Rep. of Germany | 3209989 |
| Mar. 18, 1982 | [DE] | Fed. Rep. of Germany | 3209988 |

[51] Int. Cl.[3] ..... E01C 19/34

[52] U.S. Cl. ..... 404/102; 404/118; 404/133; 404/96

[58] Field of Search ..... 404/12 D, 118, 102, 404/105, 114, 113, 133; 175/56, 55; 299/14

[56] References Cited

U.S. PATENT DOCUMENTS

| | | | |
|---|---|---|---|
| 1,840,970 | 1/1932 | Noble | 404/102 |
| 2,160,462 | 5/1939 | Schieferstein | 404/113 |
| 2,289,168 | 7/1942 | Barber | 404/102 |
| 2,351,593 | 6/1944 | Barber | 404/118 X |
| 3,283,677 | 11/1966 | Uebel | 404/113 |
| 3,403,609 | 10/1968 | Bradshaw et al. | 404/105 |
| 3,486,568 | 12/1969 | Westerlund et al. | 404/102 X |
| 3,497,017 | 2/1970 | Goehl et al. | 404/102 X |
| 3,508,476 | 4/1970 | Smith | 404/102 |
| 3,816,014 | 6/1974 | Klopf | 404/114 |

FOREIGN PATENT DOCUMENTS

| | | | |
|---|---|---|---|
| 805623 | 12/1958 | United Kingdom | 404/118 |

*Primary Examiner*—James A. Leppink

*Assistant Examiner*—Beverly E. Hjorth

*Attorney, Agent, or Firm*—James E. Nilles

[57] ABSTRACT

The invention relates to a travelling finisher apparatus for laying down a road surfacing layer of a bituminous compound material, comprising a first precompacting and levelling screed carried by a frame, and optionally a second levelling screed connected to a vibratory drive arrangement, whereby a particularly high degree of compaction is achieved so that subsequent roller compaction is not required. This is accomplished by providing a vertically guided compactor bar extending transversely of the direction of travel at the rear of the first screed and being of substantially narrower width than said first levelling plank, said compactor bar being continually in contact with the surface of the precompacted surfacing layer and adapted to be acted on by linear pulsating forces acting between the frame and the compactor bar, and generated by a drive source the reaction forces of which are absorbed by the frame. As the reaction forces are taken up by the frame, it is possible to make use of the mass inertia of the frame and the components associated therewith for generating extraordinarily high force levels at the compactor bar. Together with the narrow contact surface of the compactor bar, this results in very high area unit loads enabling the required high compaction degrees to be achieved. This is also enhanced by tuning the frequency of the compaction force pulses to the natural frequency of the system. The compactor bar and the levelling screed following it may be divided into sections adapted to be angularly adjusted relative to one another for forming roof- or trough-shaped surface profiles.

16 Claims, 12 Drawing Figures

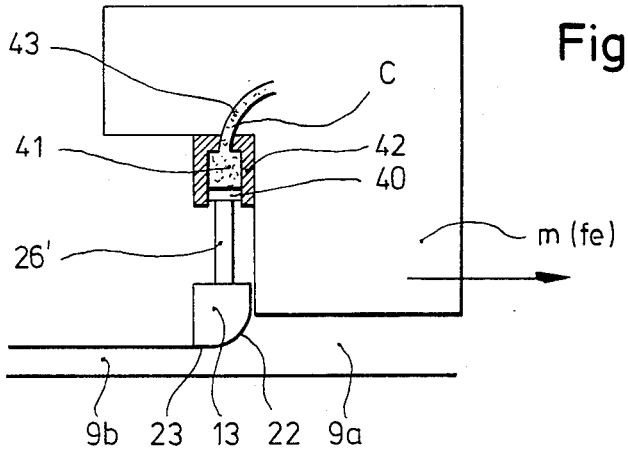
Fig.7
Fig. 8
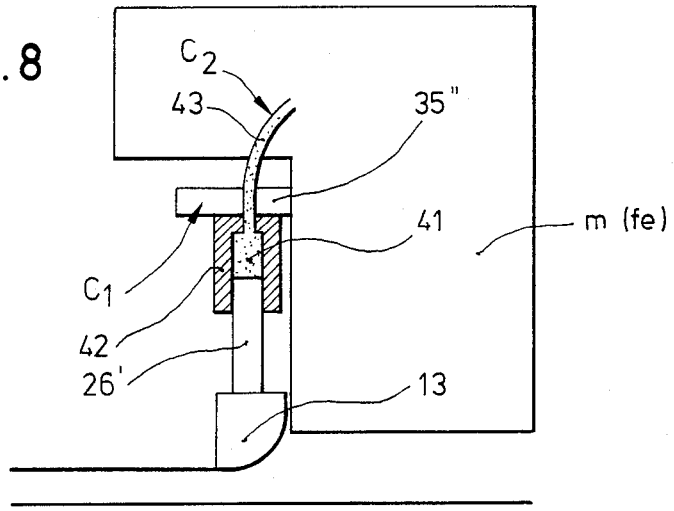
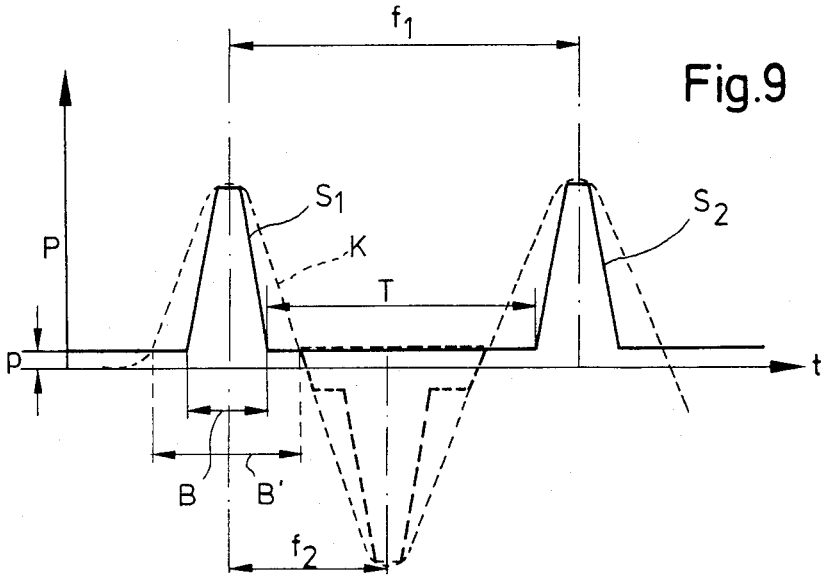
Fig.9

BITUMINOUS FINISHER

BACKGROUND OF THE INVENTION

This invention relates to a travelling finisher apparatus for making a road surface layer of a bituminous compound material, said apparatus comprising a first precompacting and levelling screed carried by a screed frame, and optionally a second levelling screed connected to vibratory drive means.

From a paper read by Mr. M. Blumer at a symposium on modern soil and asphalt surface layer compaction techniques held on Nov. 22 and 23 at Biel, Switzerland, it has become known that the service life of a road surface layer consisting of a bituminous compound material (asphalt surface layer) depends largely on the reduction of the voids therein to the smallest possible volume. The determining factor of the void volume is the degree of compaction which may be measured in drill core samples by means of a Marshall test body. The degree of compaction is the specific weight of the core sample as related to the specific weight of the Marshall test body. According to the findings explained in this paper, modern requirements can only be met by asphalt surface layers having a degree of compaction of at least about 98 percent. In practice a compaction degree of this magnitude has been achieved by providing a travelling finisher apparatus employed for laying down the surface layer with a hydraulically operated compactor bar adjacent the leading edge of the levelling screed, cooperating therewith to precompact the road surface layer to a maximum compaction degree of 93.5%. The compactor bar streaks the compound material to the proper level and compacts it by a ramming action as well as by means of its oblique leading face effective to compress the material to a reduced cross-section. The subsequently acting levelling screed is effective to close and to smoothen the surface. The subsequently required final compaction to a compaction degree of at least 98% requires the employment of road rollers immediately following the finisher apparatus. This purpose is achieved by means of static smooth-walled rollers and/or vibratory rollers, which may have to travel as much as ten times over each surface unit of the road surface layer. As the rolling operation has to be carried out synchronously with the travel of the finisher apparatus, the wide lanes laid down in large-capacity roadbuilding operations require the simultaneous employ of a plurality of rollers for enabling the requisite roller compaction to be carried out synchronously with the finisher travel with the road surface layer still in the plastic state. This final compaction is usually carried out with static pressures of about 3 to 12 kp/cm$^2$.

In finisher apparatus known from DE-OS Nos. 17 84 633 and 17 84 634, the second levelling screed is formed as a trailing vibratory compactor provided with vibratory drive means. The compactor contacts the precompacted surface layer with a skid-shaped vibrator plate extending in the travelling direction over a length corresponding approximately to one half of the travel path width. Mounted on the vibrator plate are rotary driven shafts carrying eccentric weights for generating pulsating forces in all directions in planes extending perpendicular to the shafts. The maximum downward directed resultant force obtainable by this vibration system corresponds to no more than twice the total weight of the compactor. A greater resultant force would cause the compactor to start jumping, which would result in damage at least in the surface area of the road cover layer. As the resultant force available for the compaction process is thus limited and is moreover distributed over the large surface of the vibrator plate, the specific surface unit load is far too small to permit a compaction degree of for example 98% to be obtained thereby. Although in both references cited above it is emphasized that the compaction degree obtained is so high as to render subsequent roller compaction unnecessary, it has been found in practice that the actually obtainable compaction may just barely suffice in the case of poured asphalt, whereas in the case of normal compound layers subsequent roller compaction is absolutely necessary. It is also obvious that with this compactor, i.e. with the large area of the vibrator plate it is impossible to obtain the specific surface unit loads achieved in the case of roller compaction by the substantially linear contact area of the roller. In addition it is to be noted that due to the employed drive system with rotating eccentric masses, the pulsating forces transmitted from the vibrator plate to the surfacing layer are not restricted to vertically directed forces, but also include forces acting in the travel direction or obliquely thereto, such forces being undesirable in any case.

SUMMARY OF THE INVENTION

It is thus an object of the invention to provide a finisher apparatus of the type set forth in the introduction, which permits a considerably higher compaction degree of the laid-down surface layer to be achieved than with the known solutions.

For attaining this object the invention provides apparatus having a vertically guided compactor bar extending transversely of the travelling direction at the rear of the first levelling screed in the direction of travel and being of substantially narrower width than the first levelling screed, said compactor bar being continually in contact with the surface of the precompacted surfacing layer and adapted to be acted on by linear pulsating forces acting between the screed frame and the compactor bar and generated by a drive source the reaction forces of which are absorbed by the screed frame.

The compactor bar engages the road surface layer with a substantially smaller contact surface than for instance a second levelling screed with a vibratory drive means or the above described known finishing compactors with their large-area vibrator plates. As the pulsating forces applied to the compactor bar are taken up by the screed frame and are directed downwards, the total force values achieved are substantially greater than hitherto possible. The total force value may thus indeed be greater than twice the weight of the screed frame with the elements mounted therein. This implies altogether that the specific area unit load is as great as, or even greater than, in the case of a roller with its line contact. This is because the compactor bar, too, is in contact only with a narrow, ribbon-shaped surface area. In practical operation it has thus been surprisingly found that, probably due to the dynamics of this specific operating manner of the compactor bar, the specific area unit loads are considerably greater than could have been expected in consideration of the mass of the screed frame with the components contained therein. The absorption of the reaction forces by the screed frame permits the inertia of the screed frame to be utilized for the application to the compactor bar of compaction forces greater than twice the weight of said mass.

In an advantageous embodiment of the invention there is provided a mechanical or hydraulic pulsating force drive means for the compactor bar. Force generating drive means of this type permit the requisite great forces to be continuously and reliably applied to the compactor bar.

In a further suitable embodiment of the invention one or both levelling screeds may be provided with vertical guides for the compactor bar, whereby the compactor bar is braced against the reaction forces resulting from the travel of the finisher apparatus, so that the compaction forces are introduced into the surface layer in a controlled manner.

In a further advantageous embodiment the leading portion of the compactor bar may be provided with an obliquely rising pressure surface extending from the lower surface of the compactor bar at a lower level than the lower surface of the first levelling screed at least to the level of the lower surface of the first levelling screed. The oblique pressure surface compensates the level difference between the precompacted and the finish-compacted layer surface and assists in the compacting operation, while the lower surface of the compactor bar exerts compaction forces acting vertically into the surfacing layer, and that over a relatively small surface area, so that the requisite high specific area unit loads are obtained.

In a further advantageous embodiment the invention provides that the compactor bar is connected through at least one resilient element to a pressure beam mounted for linear upward and downward movement and coupled to a crank or cam drive arrangement mounted in the screed frame. The crank or cam drive arrangement is effective to generate an oscillating movement of the pressure beam, from where the resilient element transmits exclusively downwards directed compacting force pulses to the compactor bar. The shape of the compacting force pulses may be pre-determined by properly selecting the design of the drive arrangement so as to obtain an optimum compaction effect over a wide range.

Between the pressure beam and the compactor bar there is preferably arranged a plurality of preferably pre-stressed compression springs. This prevents the compactor bar from being lifted off the surface, that is, the compactor bar is always held in pressure contact, with the contact pressure varying in accordance with the frequency and the magnitude of the compacting force pulses. The compression springs are effective to transmit the compacting force pulses to the compactor bar only during downward movement of the pressure beam, while upward movement of the pressure beam results in the compactor bar being relieved, although only up to a point determined by the pre-stressed condition of the compression springs.

In a preferred embodiment of this kind, the compression springs are in the form of helical compression springs mounted on guide rods of the compactor bar, said guide rods extending through the pressure beam into engagement with vertical guides provided on the or each levelling screed. This type of mounting prevents the compression springs from buckling sideways. At the same time, the guide rods brace the compactor bar against the reaction forces resulting from the travel of the finisher apparatus.

The operating stroke and the rotary speed of the crank- or cam drive arrangement are preferably adjustable, so that the shape and magnitude of the compacting force pulses may be varied in accordance with the consistency and thickness of the surfacing layer to be laid down.

In an alternative embodiment of the invention, a hydraulic compaction force drive means may comprise at least one hydraulic cylinder supported relative to the compactor bar by a levelling screed or by the screed frame and having a working chamber containing a work piston rigidly connected to the compactor bar. In a hydraulic drive arrangement there are no vibration-caused forces of oscillations which are not directed parallel to the direction of the compacting force pulses, thus permitting particularly great compaction force values to be achieved. Moreover, the energy loss caused by the deformation effort in the mechanical drive arrangement is substantially eliminated in the hydraulic system, as the compressible hydraulic medium column forms a spring constant within the system which plays an important role for the operation of the compactor bar as related to the natural frequency of the system formed by the screed frame and the components mounted therein. The spring formed by the hydraulic medium column operates with lower loss, however, than a mechanical spring.

According to a further characteristic feature of the invention said work chamber may be adapted to be applied with a pulsating pressure through a hydraulic control device. These pressure pulses are converted into the actuating force pulses that are applied to the compactor bar.

In practice it has been found particularly effective if the hydraulic control device comprises a variable-speed rotary valve the inlet pressure of which is adjustable. These two variables then permit the actuating force pulses to be adjusted with regard to their shape, their frequency and their magnitude.

A further advantageous embodiment is characterized by the fact that the compactor bar is suspended from a counter support by means of at least one tension spring acting opposite to the direction of the pulsating force. This tension spring determines the selected pre-tension of the compactor bar, so that the pulsating force does not every time have to be built up from zero to its maximum value, as the compactor bar continuously rests on the surface with the selected pre-tension pressure. In addition the tension spring prevents the compactor bar from drooping during transport of the finisher.

In a further preferred modification of the subject matter of the invention the screed frame may be connected to the finisher apparatus as a structural unit by means of pivotable booms and vertical supports adapted to be actuated for transport or rearward travel of the finisher apparatus. This structural unit may also be attached to already existing finisher apparatus of conventional type, whereby such existing finishers are enabled to lay down surfacing layers with the required high degree of compaction without subsequent roller compaction. The vertical supports finally permit the screed frame and its structural components to be lifted to a non-operative position for transport.

In a further embodiment of the subject matter of the invention it is of importance that the pulsating force frequency is equal to or higher than the natural frequency of a system including the mass represented by the screed frame and the components carried thereby, and a spring component acting between the compactor bar and the support absorbing the reaction forces. In addition to the purely static loads on the compactor bar, this feature permits a dynamic effect to be obtained that results in a spectacular increase of the compacting forces exerted by the compactor bar, as the inertia of the system is made use of to increase the pulsating force values. If the frequency of the pulsating force is equal to the natural frequency of the system, the resulting resonance phenomena lead to the forces exerted by the compactor bar becoming greater than the dead weight of the screed frame and its components. On the other hand it has been found that a pulsating force frequency above the natural frequency of the system also permits substantially greater compaction forces to be achieved than might be expected from the dead weight of the system. This desirable effect may be assumed to be due to the dynamic relationships resulting from the operations in the above described manner.

For the faultless compaction of the surfacing layer to the desired high degree it is of importance, according to a further aspect of the invention, that in diagrammatic representation the compaction force pulses form half-wave shaped curves of a narrower width and more pointed shape as compared to a sine wave configuration. Due to this pointed and narrow shape, the compaction force pulses are enabled to penetrate the surfacing layer to the desired depth.

In a further advantageous embodiment of the subject matter of the invention it is proposed that in diagrammatical representation there is a time interval between each two compaction force pulses, the length of such interval being greater, particularly several times greater than the half wave length of a compaction force pulse. This time interval may be achieved in a simple manner by forming the compaction force pulses narrower and of more pointed shape as compared to a sine wave configuration. In this case the time interval between each two compaction force pulses will be determined by the magnitude by which the force pulses are narrower than corresponding sine wave pulses. This time interval permits the entire system to come to rest before a new compaction force pulse occurs.

In accordance with a further important aspect of the invention, the magnitude of the time interval between any two compaction force pulses may be adjusted to the travelling speed of the finisher apparatus in such a manner that the longitudinal section of the surface layer compacted by the compactor bar at a single force pulse is shorter than the width of the lower surface of the compactor bar in the direction of travel. During the time interval between the compaction force pulses the entire system comes to rest, and the compactor bar is advanced over the surfacing layer to be compacted in the direction of travel. The advancing stroke of the compactor bar up to the occurrence of the next compaction force pulse may not be too short, as there would otherwise be the danger of the surfacing material particles being crushed. On the other hand, the advance stroke may not be too great, as this might result in a reduced compaction effect or in the formation of an elevation in front of the compactor bar which the latter would tend to climb due to the reaction forced created by the advancing movement. The above described provisions permit the shape, the magnitude and the frequency of the compacting force pulses to be tuned to the natural frequency of the system in a simple manner, additionally taking into account the type and thickness of the surfacing layer as well as the temperature and other physical parameters.

A further advantageous embodiment of the subject matter of the invention, in which there is provided a hydraulic drive arrangement for generating the compaction force pulses, is characterized in that said spring component is provided by the hydraulic fluid column acting in the system for actuating the compactor bar. This spring constant may be determined by calculation so that, with a given mass of the system, it is possible to determine its natural frequency, which in turn governs the frequency of the compaction force pulses. Although the hydraulic fluid is in theory not compressible, it does in practice show a certain degree of compressibility enabling the hydraulic fluid column to act as a spring under pressure exerted thereon.

In a further advantageous embodiment including a hydraulic drive arrangement and a hydraulic cylinder there may be provided a resilient connection between the hydraulic cylinder and the screed frame or levelling screed, respectively. This resilient connection intentionally provides for a spring component which is predetermined with respect to the oscillation dynamics of the system and permits the natural frequency of the system to be influenced.

In a particularly suitable practical embodiment the resilient connection may be formed by a resiliently bendable beam cantilevered in a direction vertical to the linear pulsating forces. This beam may be selectively cantilevered or supported at both ends. It serves as a counter support for absorbing the reaction forces of the compaction force pulses and acts simultaneously as a spring acting in the direction of the compaction force pulses. The counter support is rigid in all directions extending obliquely or transversely with respect to the direction of the compaction force pulses, so that there cannot occur any undesirable relative movements.

A further suitable embodiment of the subject matter of the invention is characterized by the provision that along its working width extending transversely of the direction of travel, the compactor bar is divided into at least two sections interconnected by a hinged joint in such a manner that the lower surfaces of the sections contacting the surface of the surfacing layer are adapted to be angularly adjusted relative to one another in accordance to the road profile, without being adjustable to staggered levels relative to one another. With a compactor bar of this type it is possible to reliably and uniformly compact profiled road surfaces without the danger that an undesirable step or rib is formed in the finished surface layer by adjustment of the adjacent ends of the two compactor bar sections to different levels.

A further advantageous embodiment of the subject matter of the invention is characterized by the provision that along its working width extending transversely of the direction of travel, the second levelling screed is divided into at least two sections interconnected by a hinged joint in such a manner that their lower surfaces contacting the surface of the surfacing layer are adapted to be angularly adjusted relative to one another in accordance with the road profile without being adjustable to different levels relative to one another, the separation gap between the sections being rectilinear and extending obliquely to the direction of travel. In this manner it is thus possible to adjust also the trailing levelling screed to the surface profile. Thanks to its obliquely extending separation gap the levelling screed will not only level a surface rib possibly formed by the separation gap of the compactor bar, but will itself be unable to form such rib on the finished surface.

In this context the trailing end of the separation gap of the compactor bar is preferably slightly offset relative to the leading end of the separation gap of the second levelling screed. The surface rib exiting from the separation gap of the compactor bar is thus prevented from entering the obliquely extending separation gap of the second levelling screed and from moving therethrough, but will instead be reliably levelled down by the levelling screed.

According to a specific aspect of this embodiment, the trailing and of the separation gap of the levelling screed is laterally offset with respect to its leading end by at least the width of the separation gap. This provision ensures that no elevations can be formed in the surface of the finished surfacing layer at the location of the separation gap, as there is no linear passage extending through the second levelling screed in the direction of travel.

Embodiments of the invention shall now be described with reference to the accompanying drawings, wherein:

FIG. 1 shows a diagrammatical side elevation of a travelling finisher apparatus during laying down a bituminous surfacing layer, FIG. 2 shows an enlarged detail of FIG. 1 in cross-section, FIG. 3 shows a first embodiment of a drive arrangement for generating pulsating compaction forces as employed in the finisher apparatus of FIG. 1, FIG. 4 shows an enlarged cross-sectional view of the drive arrangement shown in FIG. 3, FIG. 5 shows a cross-sectional view of a second embodiment of a drive arrangement for the compactor bar, FIG. 6 shows a front end view of the drive arrangement of FIG. 5 together with a hydraulic control circuit, FIG. 7 shows a detail of the embodiment of FIG. 5, FIG. 8 shows a diagram of a further embodiment, FIG. 9 shows a graph representing the shape and frequency of the compaction force pulses transmitted from the compaction bar into the surfacing layer, FIG. 10 shows a detail view similar to FIG. 3 of a further embodiment, FIG. 11 shows a detail view of components not visible in FIG. 10, and FIG. 12 shows a top plan view of components of the embodiment of FIG. 10.

DESCRIPTION OF PREFERRED EMBODIMENTS

Figure 1:
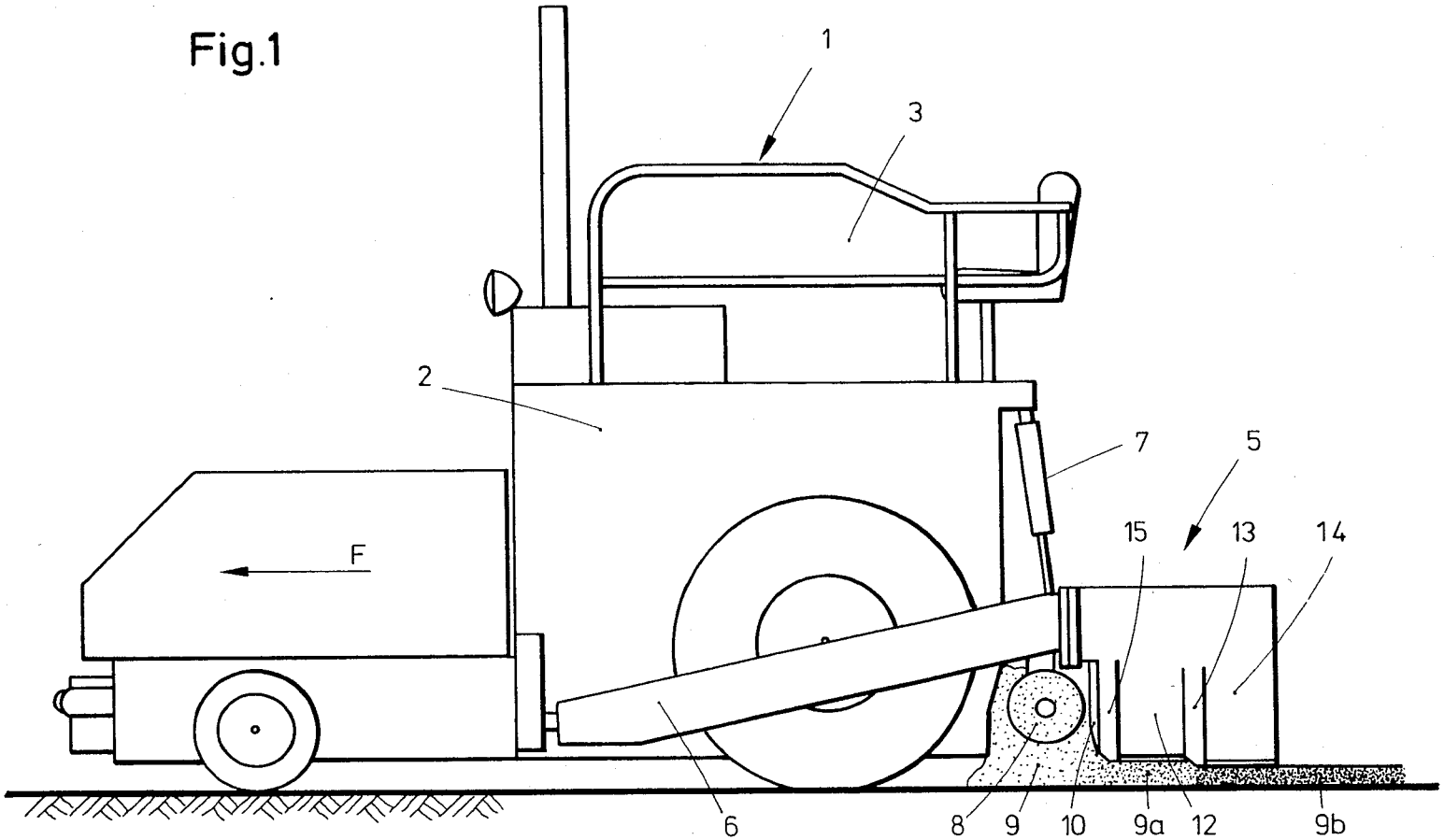

A travelling finisher apparatus 1 for laying down a road surfacing layer of a bituminous compound material, e.g. an asphalt surfacing layer, comprises a wheeled undercarriage 2 carrying an operator's cabin 3, and is adapted to travel in the direction of arrow F. Attached to the rear end of finisher apparatus 1 by means of pivotal booms 6 and a lifting arrangement 7 is a screed frame 5 including components for pre-compacting and final compacting of the surfacing layer. Located the finisher apparatus are containers (not shown) for receiving the compound material, from where said material is fed to a distributor arrangement, e.g. a transverse auger 8 by means of which it is spread on the subjacent floor surface. In this manner there is provided a loose layer 9 in front of a levelling blade 10. A first levelling screed 12 located to the rear of blade 10 is preceded by a vertically movable ramming bar 15. At this location the surfacing layer 9*a* is precompacted to a compaction degree of about 92 to 94%. Located to the rear of first levelling screed 2 relative to the direction of travel F is a compactor bar 13 extending transversely of the direction of travel and effective to compact the precompacted surfacing layer to a final compaction degree of about 98% (9*b*). This is followed by a second levelling screed 14 provided for levelling surface irregularities possibly caused by compactor bar 13.

Figure 2:
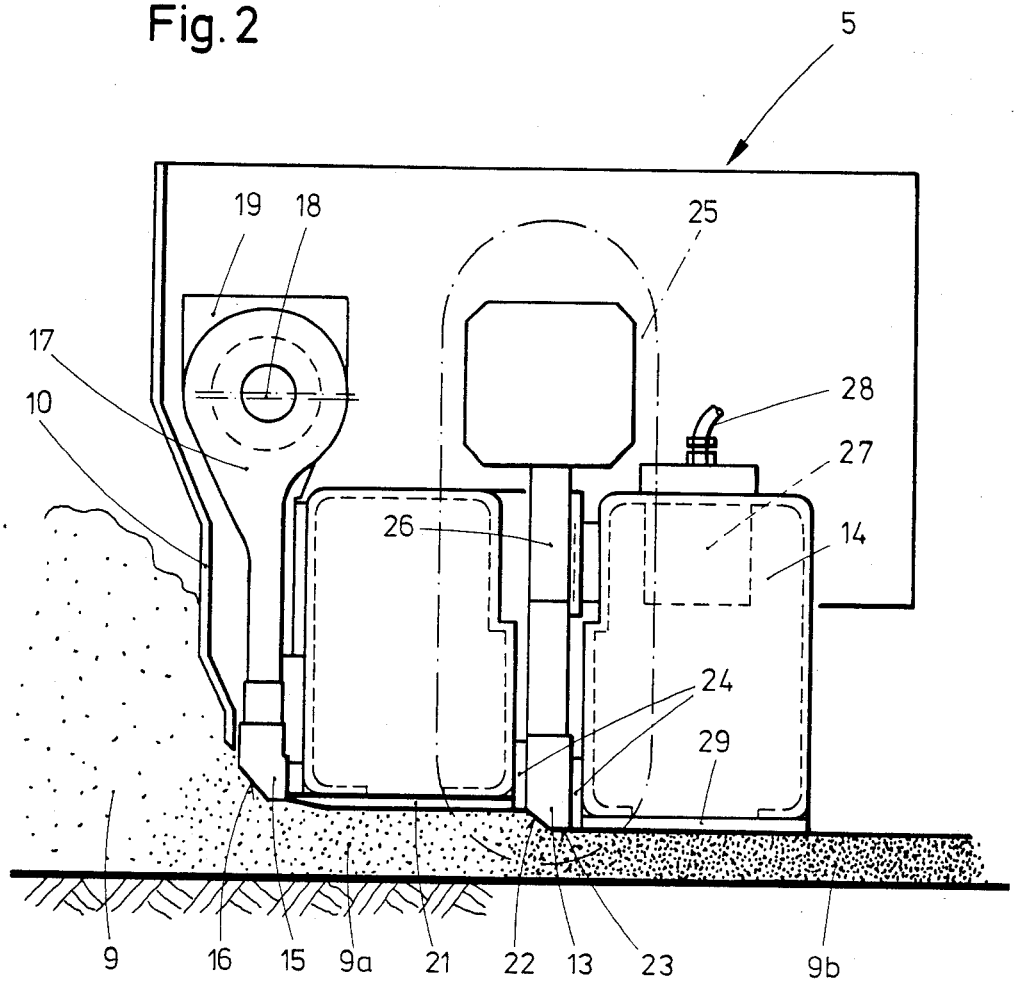

The construction of screed frame 5 is more clearly shown in FIG. 2. Ramming bar 15 has an inclined leading pressure face 16 and is operatively connected by means of drive transmitting members 17 to an eccentric drive arrangement 18 mounted in stationary bearings 19 and adapted to be driven by a suitable drive source (not shown). Ramming bar 15 is advantageously guided for vertical movement at the leading face of first levelling screed 12. The lower surface of levelling screed 12 is formed by a levelling plate 21 contacting the surfacing layer for levelling any surface irregularities caused by ramming bar 15. Levelling screed 12 may optionally be provided with a vibrator device (not shown).

Between first levelling screed 12 and second levelling screed 14, compactor bar 13 is slidably guided in vertical guides 24 on said levelling screeds. Compactor bar 13 has a plane, narrow lower surface 23 and an obliquely rising forward pressure face 22 for bridging the difference in height between the lower surface of levelling plate 21 and the lower surface of a levelling plate 29 attached to second levelling screed 14. Compactor bar 13 is operatively connected to a compaction force drive arrangement 25 through a number of guide rods 26.

The second levelling screed may also be provided with a vibrator device 27 fed via a hydraulic line 28.

Figure 3:
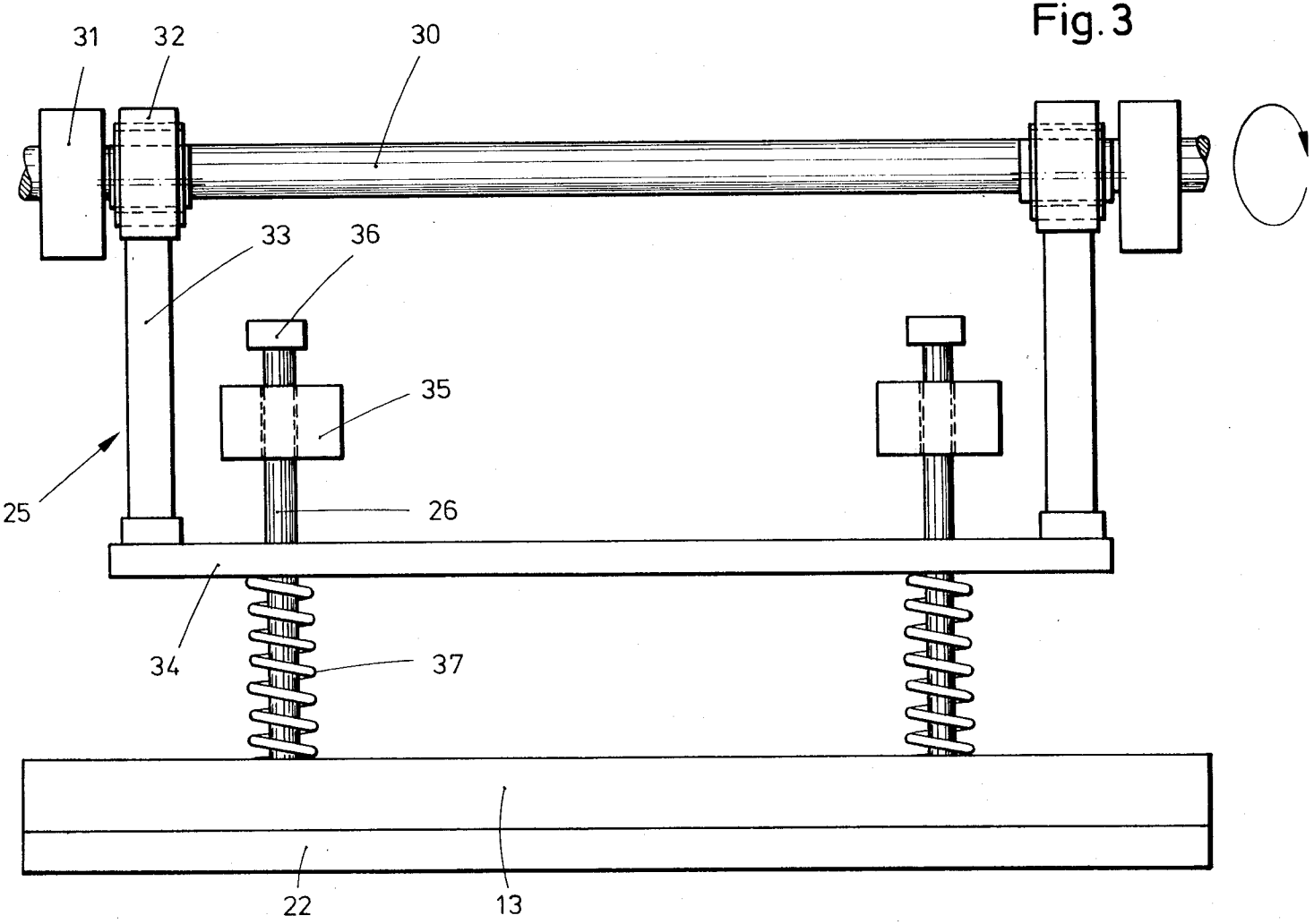
Figure 4:
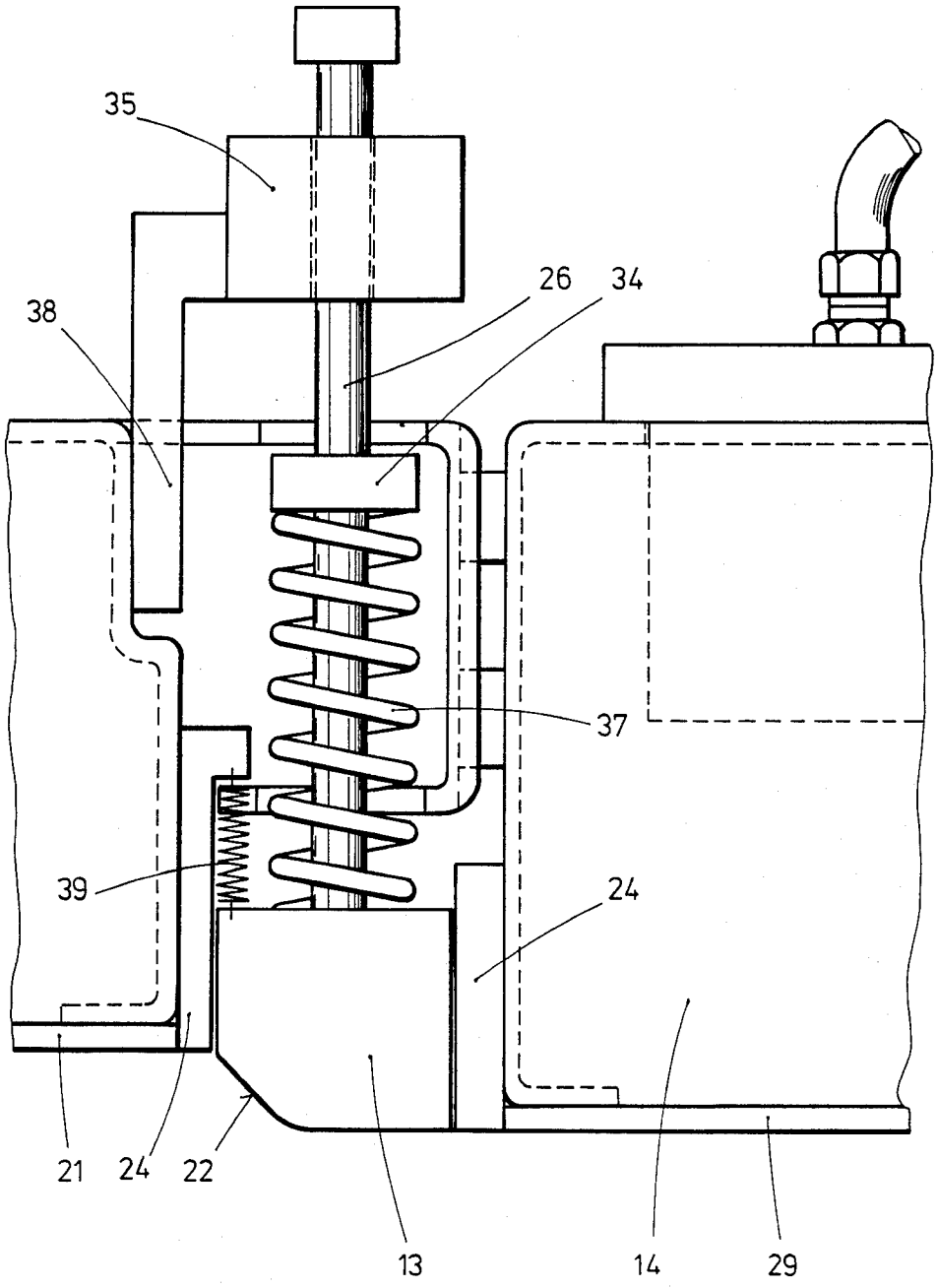

FIGS. 3 and 4 show one embodiment of the drive arrangement 25 for compactor bar 13.

A crank or cam drive shaft 30 is rotatably mounted in stationary bearings and carries eccentric drive members 31. Follower members 32 cooperating with shaft 30 are connected through push rods 33 to a pressure beam 34 located therebelow through which the guide rods 26 carrying the compactor bar 13 extend. In addition to being guided in vertical guides 24, compactor bar 13 is also guided by engagement of guide rods 26 with vertical guides 35 attached to screed frame 5 or to first levelling screed 12 by means of brackets 38. Disposed between pressure beam 34 and the upper surface of compactor bar 13 is a plurality of preferably pre-tensioned helical compression springs 37 adapted to convert the oscillating movement of pressure beam 34 under the action of the drive arrangement into vertically directed linear compaction force pulses without upward and downward movement of compactor bar 13. Within pressure beam 34 guide rods 26 are guided in slide bearings not shown in detail.

Compactor bar 13 is suspended by means of at least one tension spring 39 from a stationary counter support, for instance from vertical guides 24 of forward levelling screed 12 in such a manner that compression springs 37 are slightly precompressed and that compactor bar 13 is prevented from drooping during transport.

Figure 5:
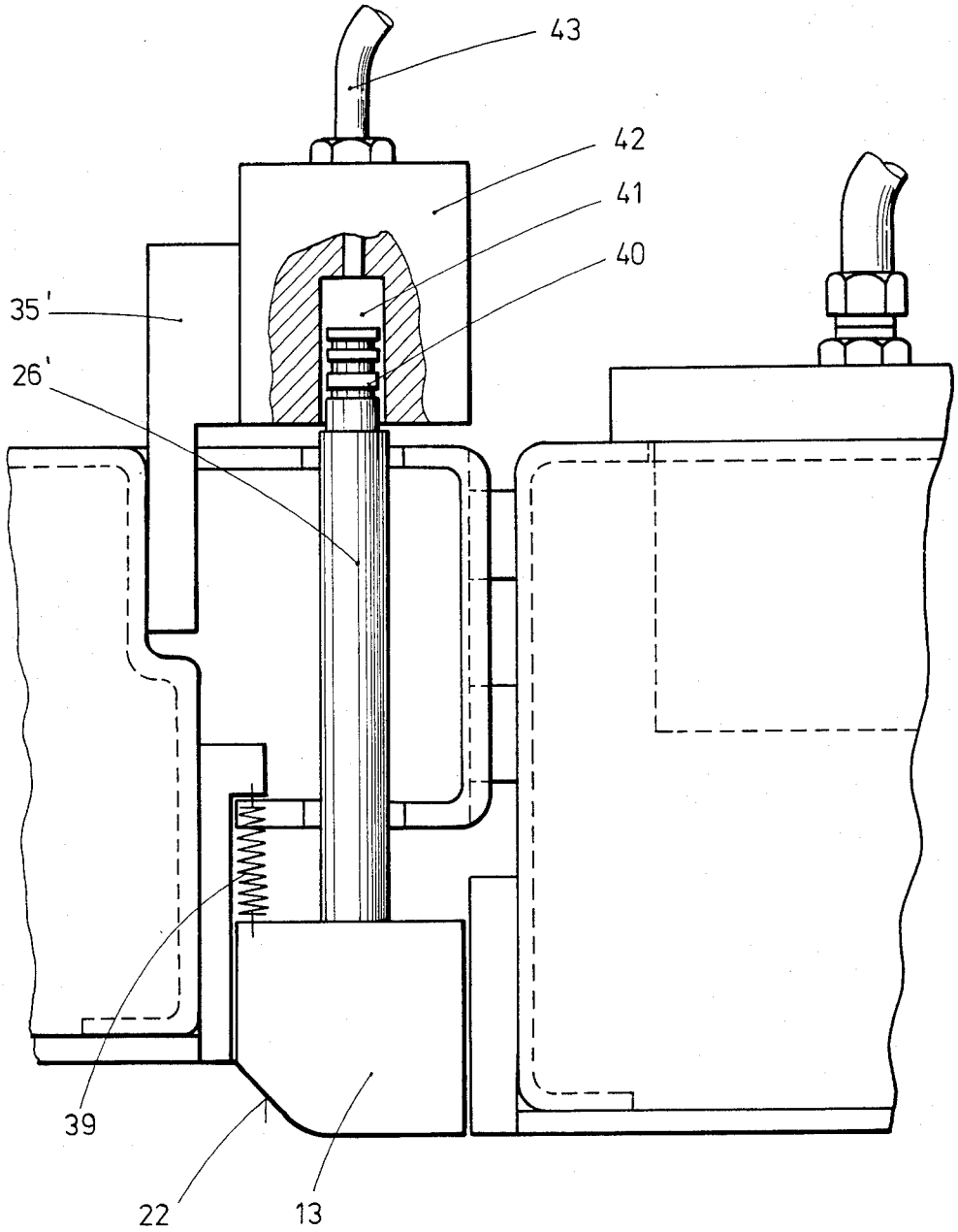
Figure 6:
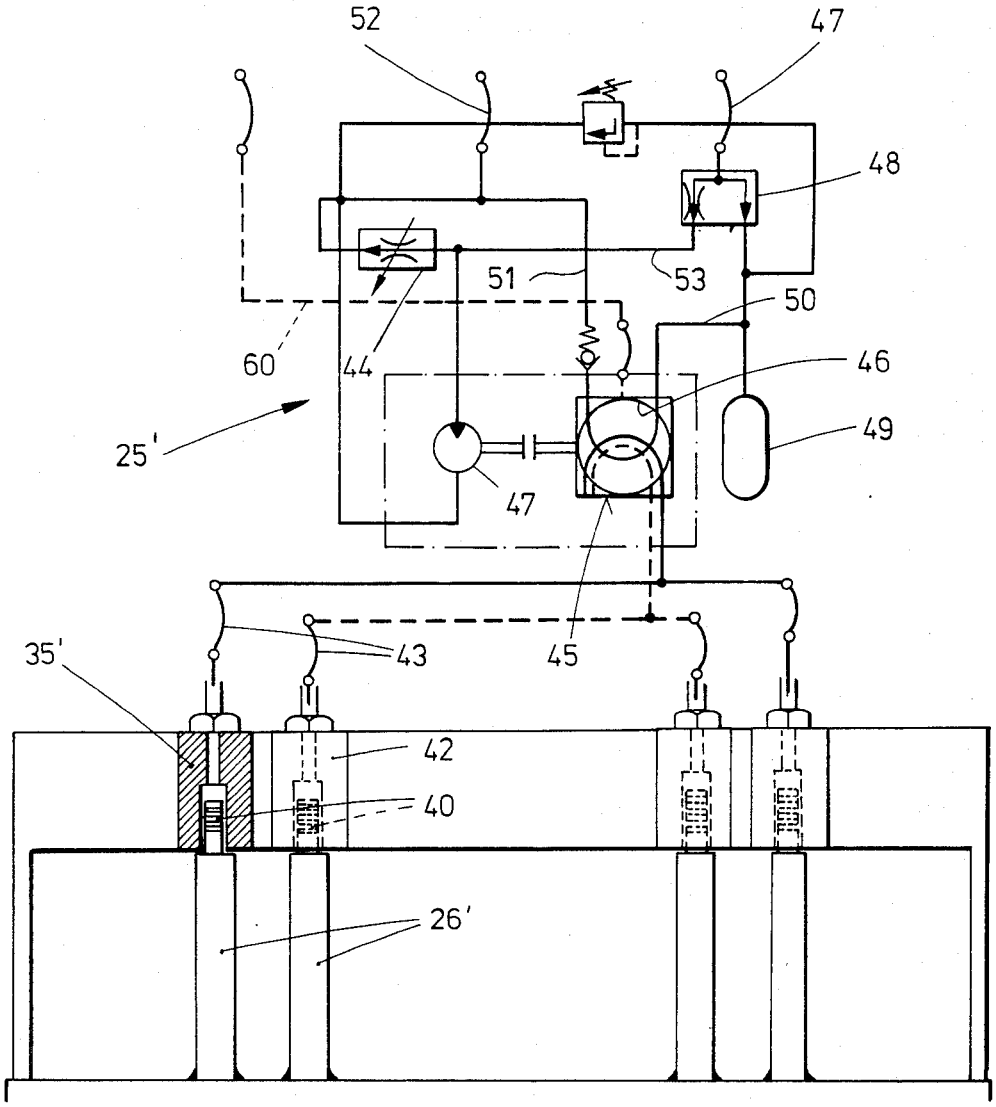

FIGS. 5 and 6 show a second embodiment of a drive arrangement 25' for compactor bar 13. In this embodiment, compactor bar 13 is also suspended by means of tension springs 39. The upper ends of guide rods 26' are formed as or connected to a hydraulic piston 40 sealingly guided in a working chamber 41 of a hydraulic cylinder 42, each cylinder 42 being attached to a mounting 35' on screed frame 5 or levelling screed 12, respectively. Hydraulic feed ducts 43 connect all working chambers 41 to a control element 45 containing a rotary valve 46. Rotary valve 46 is adapted to be rotated by a variable-speed hydraulic motor 47 to control the hydraulic pressure feed of working chambers 41. Hydraulic fluid is fed to control element 45 through duct 50 connected to the outlet of a tap valve 48 and leading to a pressure accumulator 49. Inlet 47 of tap valve 48 is connected to a pressure source (not shown). Another duct 53 connects the other outlet of tap valve 48 to the inlet of hydraulic motor 47, there being provided an adjustable throttle element 44 for controlling the rotary speed of hydraulic motor 47 and rotary valve 46 and thus the frequency of the compaction force pulses. A return duct 51 leads from control element 45 to a reservoir 52, to which the outlet of hydraulic motor 47 is also connected. A leak return duct 60 is also connected to control element 45.

FIG. 7 shows in diagrammatic form the components of the finisher apparatus shown in detail in FIG. 3. Screed frame 5, or first levelling screed 12, respectively, is shown as a box-shaped mass m having a natural frequency $f_e$ of predetermined value. The natural frequency $f_e$ of mass m of the screed frame or the levelling screed, respectively, is determined not alone by the mass itself, but also by an additional spring component C included in the system. In the embodiment shown, in which hydraulic cylinder 42 is connected relatively rigidly to mass m (see also FIG. 5), spring component C is formed by the hydraulic fluid column within working chamber 41 and in feed duct 43 leading to control element 45 shown in FIG. 6. Although the hydraulic medium is in theory incompressible, it has a certain compressibility in practice, whereby it acts as a spring. In addition, feed duct 43, which is a conventional high-pressure hydraulic tube, is capable of limited elastic expansion. Together with the elastically expandable duct, the hydraulic fluid column thus acts as a spring capable of modifying the natural frequency of the system formed by mass m of screed frame 5, as this mass m is excited to vibrate by means of the drive arrangement 41, 42, 40 generating the compaction force pulses for compactor bar 13. In practice the natural frequency of this system lies within the range of 20 to 22 Hertz.

As seen in FIG. 7, piston 40 and guide rod 26' are effective to impose linear compacting force pulses on compactor bar 13, whereby the latter compacts the precompacted surfacing layer 9*a* to a thickness 9*b*. The pressure face 22 at the leading side of compactor bar 13 forms a transition between the levels of the two levelling screeds 12 and 14, while the narrow flat lower surface 23 of compactor bar 13 exerts the downwards directed compaction forces. In order that the compaction forces are sufficient to achieve the required high degree of compaction, the frequency $f_1$ of the pressure feed to working chamber 41 is selected equal to or higher than the natural frequency of the system. If the compaction force pulse frequency lies within the range of the natural frequency, the resulting resonance phenomena lead to substantially greater compaction forces introduced into the surfacing layer than might be expected in view of the known weight of mass m. In a purely static condition, a compaction force which is only slightly greater than the weight of mass m would tend to lift the mass. Due to the dynamic condition resulting from the turning of the frequencies, however, mass m is not lifted, but remains practically stationary, as does the compactor bar itself. The same occurs if the compaction force pulse frequency is higher than the natural frequency of the system, as in this case the inertia of the oscillating mass m as influenced by spring constant C is sufficiently high, so that substantially greater compaction forces can be generated and absorbed than might be expected in view of the known weight of mass m.

FIG. 8 shows a further embodiment somewhat similar to that of FIGS. 7 and 5. At this instance, however, the connection between mass m and hydraulic cylinder 42 is formed by a resilient beam 35'' fixedly attached to mass m and extending perpendicular to the direction of the compaction force pulses generated. Beam 35'' in this embodiment acts as a spring the action of which is superimposed on the spring action of the hydraulic medium column in working chamber 41 and feed duct 43. Beam 35'' thus provides one spring component C1, while the hydraulic fluid column provides a second spring component C2, which together result in a natural frequency $f_e$ of the system which is slightly lower than in the embodiment of FIG. 7, namely, about 15 to 20 Hertz. It is obvious that this lower natural frequency permits the frequency of the compaction force pulses to be selected lower than in the embodiment of FIG. 7 for operation within a resonance range. On the other hand, the frequency of the compaction force pulses need not in this embodiment be selected as high as in the embodiment of FIG. 7 for operation above the natural frequency of the system. In operation of the embodiment of FIG. 8 it is also found that due to the dynamics of the oscillating hydraulic fluid column and the reaction forces of the compaction force pulses the actually achieved compaction forces of compactor bar 13 are substantially greater than would be expected under static conditions in view of the known weight of mass m. And it is only with compaction forces of this magnitude that the desired high degree of compaction of the surfacing layer is achievable.

FIG. 9 shows the shape and the timed sequence of the compaction force pulses in the form of a diagram, wherein the interrelation between the magnitude of the compaction force, drawn in the vertical direction, and the duration of the force pulses, drawn in the horizontal direction, becomes evident. A horizontal line at a distance p above the horizontal axis symbolizes the preloading of compactor bar 13 as by tension spring 39 shown in FIG. 4. The dotted line shows a sine wave configuration that would be achieved if compactor bar 13 were capable of undampened oscillation. As the surfacing layer acts, however, as a nearly ideal dampening medium, the portions of the oscillation waves below the horizontal axis are eliminated. The configuration of the compaction force pulses, two of which are shown at S1 and S2, is considerably narrower and more pointed as compared to the half waves of the sine wave configuration above the horizontal axis. In the sine wave configuration shown in dotted lines the pulse width would be B', while the narrower configuration of pulses S1 and S2 results in a reduced pulse width B, corresponding to a shortened active period of the compaction force pulses. The actual width and thus the magnitude of each compaction force pulse can be calculated from a theoretical frequency $f_2$ determined by the time interval between the positive and the negative reversal point of a half wave of the compaction force pulses. It is obvious that the higher this theoretical frequency $f_2$, the narrower, higher and more pointed are the compaction force pulses S1 and S2.

In practice, however, compaction force pulses S1 and S2 act on the surfacing layer with a frequency $f_1$, whereby the system is caused to oscillate at this lower frequency $f_1$ which is determined by the time interval between the fading of the one compaction force pulse S1 and the build up of the succeeding force pulse S2. During this interval T the system comes to rest, while compactor bar 13 is advanced a certain distance depending on the travelling speed of the finisher apparatus. This pulse characteristic is selected on purpose, in order on the one hand to avoid crushing of the surfacing material caused by a too short interval in relation to the travelling speed, and on the other hand to avoid insufficient compaction of the surfacing layer caused by too long intervals T.

In the hydraulic drive arrangement shown in FIGS. 5 and 6, the control of time interval T may be accomplished in a simple manner by proper design of the rotary valve 46 in control element 45. The outlet ports of rotary valve 46 may thus be formed in such a manner, that the flow passage is apruptly opened and closed on rotation of the rotary valve, succeeded by a rest phase corresponding to interval T. It is thus possible to select the frequency $f_2$ by properly adjusting the rotary speed of rotary valve 45, while the configuration of compaction force pulses S1, S2 is determined by the arrangement and shape of the outlet ports. The magnitude of the compaction force pulses may be adjusted in a simple manner via the inlet pressure at the rotary valve. The interval between force pulses may for instance be determined by providing the rotary valve with one or more control ports. It is thus possible to selectively determine the width and profile of the compaction force pulses, and thus the theoretical frequency $f_2$, as well as, independently thereof, the time interval T between successive force pulses S1, S2, and thus the actual oscillation frequency $f_1$. As already stated, the frequency $f_1$ is selected in a desired relationship to the natural frequency of the system $f_e$ (FIGS. 7 and 8).

In the mechanical drive arrangement according to FIGS. 3 and 4, the configuration of the compaction force pulses may for instance be determined by the employment of steep control cam faces, in which case the time interval between successive pulses may be determined by a neutral or rest cam surface. In this embodiment it is thus also possible to select the pulse configuration and the interval between pulses independently of one another by proper design of the rise faces and rest surfaces of the cams, respectively. In the case of the mechanical drive arrangement, the natural frequency of the system is by the way lower than in the case of the hydraulic drive arrangement, lying at about 8 to 10 Hertz.

In all embodiments, the selection of the pulse configuration, the spring component and the mass of the screed frame or levelling screed, respectively, in relation to one another permits the natural frequency of the system and the inertia of the mass to be made use of for generating greater compaction forces by means of the compactor bar than would otherwise be possible in view of the weight of the mass and of the compactor bar.

The selected narrow and pointed pulse configuration results in the occurrence of very high accelerations within the system, including the compactor bar, leading to extraordinarily great forces at the compactor bar due to the inertia forces. This interaction permits the generation of compaction forces capable of obtaining compaction degrees of up to 100%.

Figure 10:
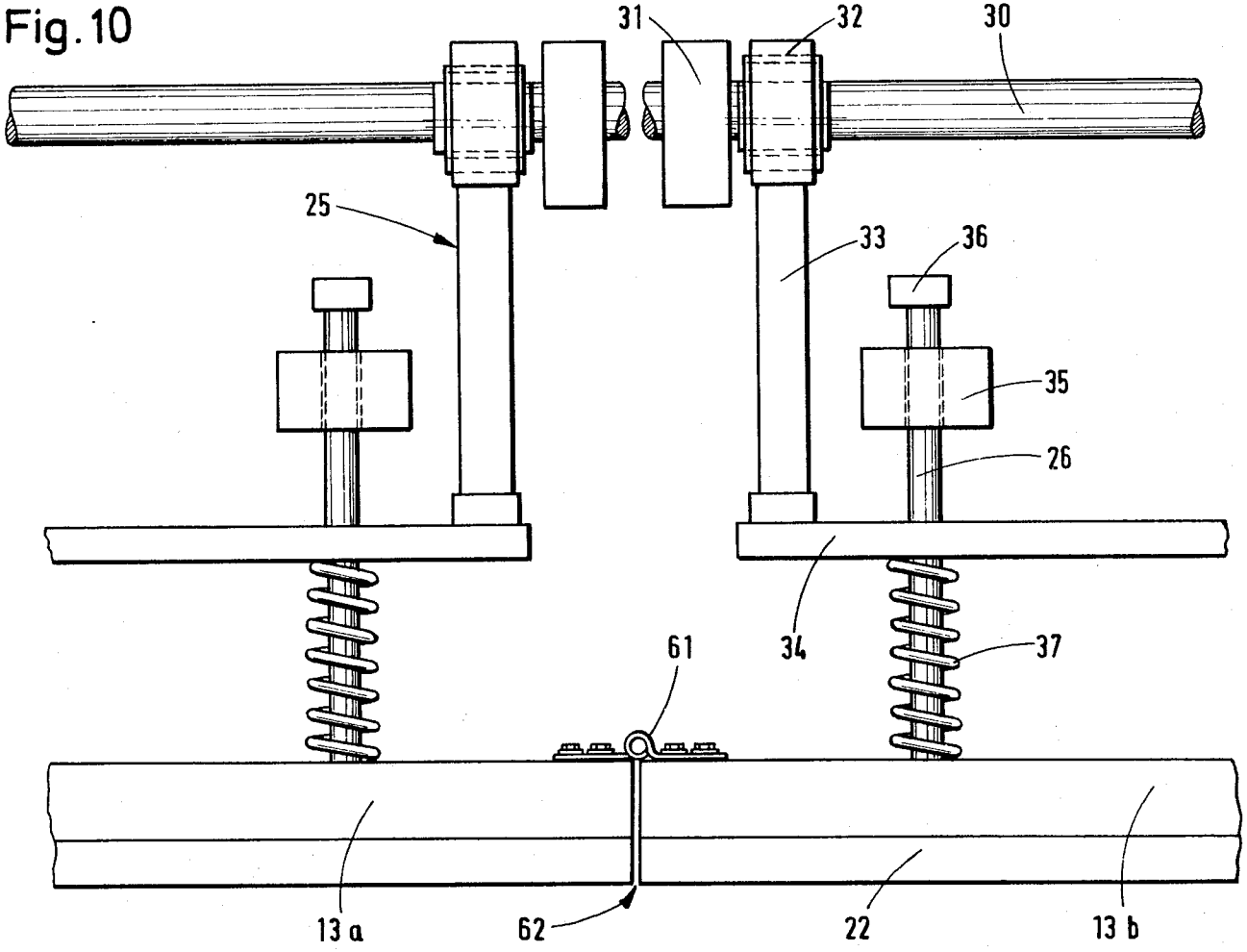
Figure 11:
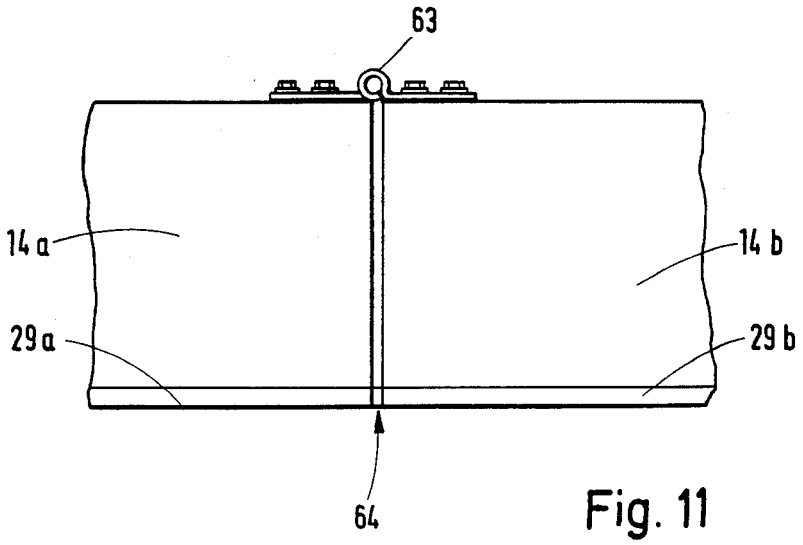
Figure 12:
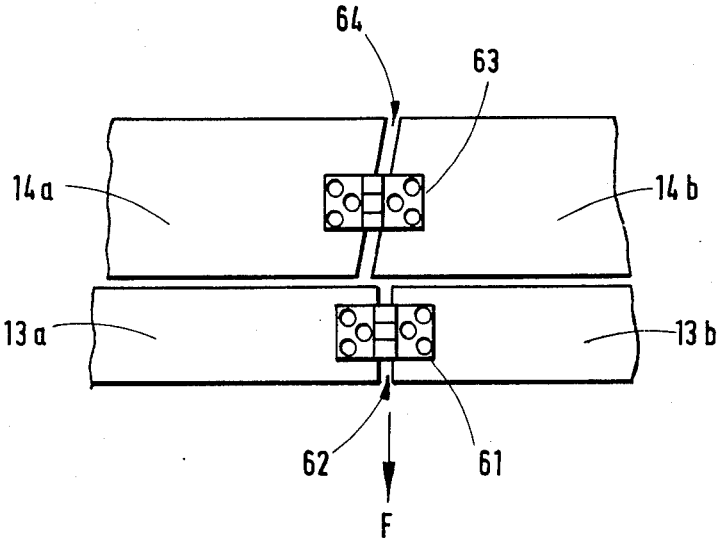

The embodiment shown in FIGS. 10, 11 and 12 is particularly suited for laying down surfacing layers having a roof-shaped or trough-shaped profile. In this embodiment, compactor bar 13 is divided into two sections 13*a*, and 13*b*. Between the adjacent end faces of sections 13*a*, 13*b*, there is a separation gap 62, the lower width of which depends on the angle of which sections 13*a*, 13*b* are adjusted relative to one another in accordance with the profile to be obtained. On the upper surface, or at an intermediate height of the compactor bar there is provided a hinge 61 permitting sections 13*a*, 13*b* to be angularly adjusted relative to one another, but not to different levels.

Shown particularly in FIG. 10 is a drive arrangement 25 for the two sections 13*a*, 13*b* of compactor bar 13. An eccentric or cam drive shaft 30 carrying drive members 31 is rotatably mounted in stationary bearings. Follower members 32 cooperating with shaft 30 are connected through push rods 33 to a pressure beam 24 therebelow. Guide rods 26 extending through pressure beam 24 each carry one of sections 13*a*, 13*b*. The compactor bar sections are guided in vertical guides 24, and additionally via guide rods 26 in vertical guides 35 attached for instance to screed frame 5 and/or to forward levelling screed 12. Between pressure beam 34 and the upper surfaces of compactor bar sections 13*a*, 13*b* there are arranged a number of helical compression springs 37 for converting the vertical oscillation of the pressure beam induced by the drive arrangement into vertical compaction force pulses without causing upward and downward movement of the compactor bar. The reaction forces of the compaction forces are directly absorbed by the screed frame or by the levelling screed itself.

FIG. 11 shows the second levelling screed 14 following compactor bar 13. It is likewise divided into two sections 14*a*, 14*b* transversely of the direction of travel, and has a separation gap 64 between bottom plates 29*a*, 29*b*. Sections 14*a* and 14*b* are connected to one another through a hinge 63.

As finally shown in FIG. 12, separation gap 64 between plank sections 14*a* and 14*b* extends somewhat obliquely with respect to the direction of travel. This enables an elevation caused by the separation gap 62 between compactor bar sections 13*a*, *13b* to be levelled down to the surface of the surfacing layer. In detail it is shown that the rear end of separation gap 62 is laterally offset with respect to the forward end of separation gap 64, and that the rear end of the latter is offset with respect to the forward end by at least the width of the gap. The axes of hinges 63 and 61 are aligned with one another.

The sections may also be interconnected by means of an articulated joint instead of through hinges.

I claim:

1. A paving machine for use with bituminous composition paving material, comprising a screed substantially rigidly carried by said frame for engagement with substantially uncompacted paving material and whereby the material is spread and substantially levelled as the machine moves forward, said screed having a substantially flat bottom surface which is elongated transversely to said forward direction and which has substantial width in said forward direction, said paving machine being characterized by:

A. a compactor bar having an elongated flat bottom surface which (1) is substantially equal in length to said bottom surface on the screed and (2) has a width substantially less than the width of said bottom surface on the screed;

B. means mounting said compactor bar on the frame, rearwardly adjacent to the screed, and whereby the compactor bar (1) is oriented with the length of its said bottom surface transverse to said forward direction and (2) is movable substantially freely relative to the frame downwardly from and upwardly to a position in which its said bottom surface is at a level no higher than that of said bottom surface on the screed;

C. force applying means comprising (1) a reciprocating element that is movable alternately up and down and (2) substantially undamped resiliently yieldable means connected with said reciprocating element;

D. means connecting said force applying means between the frame and said compactor bar to react between them and so disposing the force applying means that the compactor bar is at all times urged downwardly away from its said position under a force that increases with downward movement of said reciprocating element; and E. drive means on the frame for actuating said reciprocating element alternately up and down whereby, during each of a succession of periods that occur at substantially regular intervals, said force upon the compactor bar (1) is increased substantially steadily from a low value to a maximum value during one part of the period and (2) is decreased from said maximum value substantially to said low value during another part of the period.

2. The paving machine of claim 1, further characterized by:

(1) said compactor bar having a pressure surface that extends obliquely forwardly and upwardly from its bottom surface and terminates at a front edge which is parallel to that bottom surface, and (2) said position of the compactor bar being one in which said front edge is substantially in the plane of the bottom surface of the screed.

3. The paving machine of claim 1, further characterized by:

said drive means being arranged to drive said reciprocating element at a frequency of reciprocation which is at least as high as the natural frequency of the system comprising (1) the mass of the frame and components carried thereby that are constrained to vertical movement therewith and (2) said resiliently yieldable means.

4. The paving machine of claim 1, further characterized by:

(1) said reciprocating element comprising a piston which is reciprocable in a hydraulic cylinder carried by the frame and which has a substantially rigid connection with the compactor bar;

(2) said drive means comprising (a) a source of pressurized fluid and (b) a valve arranged to alternately connect said cylinder with said source and disconnect the cylinder from said source and vent the cylinder; and (3) said resiliently yieldable means comprising a hydraulic accumulator which is communicated with said source and is connected with said cylinder through said valve when the latter connects the cylinder with said source.

5. The paving machine of claim 1, further characterized by:

(1) said reciprocating element comprising a piston which is reciprocable in a hydraulic cylinder and which has a substantially rigid connection with the compactor bar;

(2) said drive means comprising (a) a source of pressurized fluid and (b) a valve arranged to alternately connect said cylinder with said source and with an unpressurized outlet; and (3) said resiliently yieldable means comprising a flexible connection between said hydraulic cylinder and the frame.

6. The paving machine of claim 5 wherein said flexible connection between said hydraulic cylinder and the frame comprises a resiliently bendable beam cantilevered to the frame and extending substantially horizontally.

7. The paving machine of claim 1, further characterized by:

(1) said reciprocating element comprising a beam located above the compactor bar and extending lengthwise parallel thereto, said beam being guided by the frame for up and down motion relative thereto;

(2) said drive means comprising (a) a rotatably driven shaft on the frame and (b) eccentric means on the shaft connected with the beam to translate rotation of the shaft into cyclic up and down motion of the beam; and (3) said resiliently yieldable means comprising compression spring means reacting between said beam and the compactor bar to at all times urge them vertically away from one another.

8. The paving machine of claim 1, further characterized by:

F. biasing means reacting between the frame and the compactor bar to urge the latter upwardly to said position with a force which is overcome by said force applying means.

9. The paving machine of claim 1, further characterized by:

said drive means being so arranged that each of said periods has a duration substantially less than half that of an interval between successive periods.

10. The paving machine of claim 9 wherein said drive means is further so arranged that each said interval is of such duration that during it the machine moves forward at said steady speed through a distance which is less than said width of the bottom surface of the compactor bar.

11. The paving machine of claim 1, further comprising a spreader for laying down a surface layer of paving material, and wherein said frame is connected to said spreader by means of pivotable booms and vertical supports whereby said frame can be raised for transport and for rearward travel of the machine.

12. The paving machine of claim 1 wherein said compactor bar is separated along its length into at least two sections that are lengthwise adjacent to one another, said adjacent sections being connected by hinge means to be swingable vertically relative to one another, so that said bottom surfaces of the sections can contact the surface of paving material at an angle to one another without being in vertically offset relation to one another.

13. The paving machine of claim 12 wherein adjacent ends of said adjacent sections extend at complementary rearwardly oblique angles such that the front end of a gap between said sections is offset along the length of the compactor bar from the rear end of said gap.

14. The paving machine of claim 13 wherein there is a further screed on said frame, behind the compactor bar, said further screed being elongated transversely to said forward direction and being formed in lengthwise aligned section with a gap between those sections, the last mentioned gap being offset along the length of the further screed from said gap between compactor bar sections.

15. The paving machine of claim 14 wherein said gap between the sections of said further screed is offset along the length of the latter from said gap between the compactor bar sections by a distance at least equal to the width of the latter gap.

16. A paving machine whereby a surface layer of paving material is compacted, comprising a substantially rigid frame member having downwardly facing means thereon whereby it is supported by a surface therebeneath, a compacting member confined to up and down motion relative to said frame member and having a flat bottom surface which engages material to be compacted to impose compacting force thereon, and force applying means connected between said frame member and said compacting member and reacting between them for intermittent application of force to the compacting member, characterized by:

said force applying means comprising (1) a reciprocating element movable alternately up and down relative to said frame member and having a substantially rigid force transmitting connection with one of said members, (2) substantially undamped resiliently yieldable means having a spring constant, said resiliently yieldable means being so connected between the other of said members and the reciprocating element as to react between said members through the reciprocating element and to maintain said compacting member at all times under a downward biasing force that varies in magnitude during up and down movement of the reciprocating element, and (3) drive means on the frame member for imparting alternate up and down motion to said reciprocating element at a substantially constant frequency which is no lower than the natural frequency fixed by (a) said spring constant and (b) the mass of said frame member and components carried thereby that are constrained to vertical motion therewith, so that the compacting member remains in constant engagement with material to be compacted.

* * * * *